US009615188B2

(12) United States Patent
Dublin et al.

(10) Patent No.: US 9,615,188 B2
(45) Date of Patent: Apr. 4, 2017

(54) SOUND STAGE CONTROLLER FOR A NEAR-FIELD SPEAKER-BASED AUDIO SYSTEM

(71) Applicant: Bose Corporation, Framingham, MA (US)

(72) Inventors: Michael S. Dublin, Arlington, MA (US); Tobe Z. Barksdale, Bolton, MA (US); Jahn Dmitri Eichfeld, Natick, MA (US); Charles Oswald, Arlington, MA (US)

(73) Assignee: Bose Corporation, Framingham, MA (US)

( * ) Notice: Subject to any disclaimer, the term of this patent is extended or adjusted under 35 U.S.C. 154(b) by 0 days.

(21) Appl. No.: 14/938,478

(22) Filed: Nov. 11, 2015

(65) Prior Publication Data

US 2016/0080881 A1 Mar. 17, 2016

Related U.S. Application Data

(63) Continuation of application No. 13/906,997, filed on May 31, 2013, now Pat. No. 9,215,545.

(51) Int. Cl.

| | |
|---|---|
| ***H04S 1/00*** | (2006.01) |
| ***H04S 7/00*** | (2006.01) |
| ***H04S 5/00*** | (2006.01) |

(52) U.S. Cl.

CPC ..... *H04S 1/007* (2013.01); *H04S 5/00* (2013.01); *H04S 7/30* (2013.01); *H04S 7/303* (2013.01);

(Continued)

(58) Field of Classification Search

CPC ... H04S 7/303; H04S 7/30; H04S 5/00; H04S 5/005; H04S 5/02; H04S 2420/01; H04S 2400/11; H04S 1/007; H04R 2499/13

(Continued)

(56) References Cited

U.S. PATENT DOCUMENTS

| | | | |
|---|---|---|---|
| 7,792,674 | B2 | 9/2010 | Dalton, Jr. et al. |
| 8,259,962 | B2 | 9/2012 | Augustyn et al. |

(Continued)

FOREIGN PATENT DOCUMENTS

| | | | |
|---|---|---|---|
| CN | 1391782 | A | 1/2003 |
| CN | 1640194 | A | 7/2005 |

(Continued)

OTHER PUBLICATIONS

International Search Report and Written Opinion dated Sep. 5, 2014 for International application No. PCT/US2014/038593.

(Continued)

*Primary Examiner* — Vivian Chin
*Assistant Examiner* — Jason R Kurr
(74) *Attorney, Agent, or Firm* — Bose Corporation

(57) ABSTRACT

Signals in an automobile audio system having at least two near-field speakers located close to an intended position of a listener's head are adjusted such that in a first mode, audio signals are distributed to the near-field speakers according to a first filter that causes the listener to perceive a wide soundstage, and in a second mode, the audio signals are distributed to the near-field speakers according to a second filter that causes the listener to perceive a narrow soundstage. A user input of a variable value is received and, in response, distribution of the audio signals is transitioned from the first mode to the second mode, the extent of the transition being variable based on the value of the user input.

14 Claims, 8 Drawing Sheets

(52) U.S. Cl.
CPC ..... *H04R 2499/13* (2013.01); *H04S 2400/11* (2013.01); *H04S 2420/01* (2013.01)

(58) Field of Classification Search
USPC ..... 381/17–23, 63, 86, 104, 107, 109, 302, 381/119, 310
See application file for complete search history.

(56) References Cited

U.S. PATENT DOCUMENTS

| | | | | |
|---|---|---|---|---|
| 8,654,989 | B2 | 2/2014 | Pilgrim et al. | |
| 9,167,344 | B2 | 10/2015 | Choueiri | |
| 2005/0213528 | A1 | 9/2005 | Aarts et al. | |
| 2006/0045294 | A1 | 3/2006 | Smyth | |
| 2007/0280485 | A1 | 12/2007 | Villemoes | |
| 2008/0292121 | A1 | 11/2008 | Yokota | |
| 2009/0060208 | A1* | 3/2009 | Pan | H04S 7/30 381/17 |
| 2009/0180625 | A1 | 7/2009 | Bai et al. | |
| 2011/0206224 | A1 | 8/2011 | Augustyn et al. | |
| 2012/0014525 | A1 | 1/2012 | Ko et al. | |
| 2013/0177187 | A1 | 7/2013 | Mentz | |
| 2013/0178967 | A1 | 7/2013 | Mentz | |
| 2014/0133658 | A1 | 5/2014 | Mentz et al. | |

FOREIGN PATENT DOCUMENTS

| | | | |
|---|---|---|---|
| CN | 101682813 | A | 3/2010 |
| CN | 101682814 | A | 3/2010 |
| CN | 102804814 | A | 11/2012 |
| JP | 2006273164 | A | 10/2006 |
| JP | 2007-019940 | A | 1/2007 |
| WO | 2011116839 | A1 | 9/2011 |

OTHER PUBLICATIONS

Paul White: "Improving Your Stereo Mixing", Sound on Sound, Oct. 1, 2000, XP055136742, Retrieved from the Internet: URL:http://www.soundonsound.com/sos/oct00/articles/stereomix.htm [retrieved on Aug. 27, 2014] section "Ye Old Phase Trick".

JP Office Action dated Jan. 25, 2017 for JP Application 2016-516690.

* cited by examiner

SOUND STAGE CONTROLLER FOR A NEAR-FIELD SPEAKER-BASED AUDIO SYSTEM

This application is a continuation of, and claims priority to, U.S. patent application Ser. No. 13/906,997 filed May 31, 2013 (having the same title and inventors as the instant application), which is incorporated by reference in their entirety.

BACKGROUND

This disclosure relates to a sound stage controller for a near-field speaker-based audio system.

In some automobile audio systems, processing is applied to the audio signals provided to each speaker based on the electrical and acoustic response of the total system, that is, the responses of the speakers themselves and the response of the vehicle cabin to the sounds produced by the speakers. Such a system is highly individualized to a particular automobile model and trim level, taking into account the location of each speaker and the absorptive and reflective properties of the seats, glass, and other components of the car, among other things. Such a system is generally designed as part of the product development process of the vehicle and corresponding equalization and other audio system parameters are loaded into the audio system at the time of manufacture or assembly.

Conventional automobile audio systems, with stereo speakers in front of and behind the front seat passengers, include controls generally called fade and balance. The same stereo signal is sent to both front and rear sets of speakers, and the fade control controls the relative signal level of front and rear signals, while the balance control controls the relative signal level of left and right signals. These control schemes tend to lose their relevance in a personalized sound system using near-field speakers located near the passengers' heads, rather than in fixed locations behind the passengers.

SUMMARY

In general, in one aspect, adjusting signals in an automobile audio system having at least two near-field speakers located close to an intended position of a listener's head includes, for each of a set of designated positions other than the actual locations of the near-field speakers, determining a binaural filter that causes sound produced by each of the near-field speakers to have characteristics at the intended position of the listener's head of sound produced by a sound source located at the respective designated position. An up-mixing rule generates at least three component channel signals from an input audio signal having at least two channels. A first set of weights for applying to the component channel signals at each of the designated positions define a first sound stage. A second set of weights for applying to the component channel signals at each of the designated positions define a second sound stage. The audio system combines the first set of weights and the second set of weights to determine a combined set of weights, the relative contribution of the first set of weights and the second set of weights in the combined set of weights being determined by a variable user-input value. A mixed signal corresponds to a combination of the component channel signals according to the combined set of weights for each of the designated positions. Each mixed signal is filtered using the corresponding binaural filter to generate a set of binaural output signals which are summed and output using the near-field speakers.

Implementations may include one or more of the following, in any combination. The user input providing the user-input value may be a fader input, and contribution of the first set of weights may be greater when the fader control may be in a more forward setting and the contribution of the second set of weights may be greater when the fader control may be in a more rearward setting. The audio system may include at least a first fixed speaker positioned near a left corner of the vehicle's cabin forward of the intended position of the listener's head, and a second fixed speaker positioned near a right corner of the vehicle's cabin forward of the intended position of the listener's head, with a third set of weights for applying to the component channel signals for each of the fixed speakers to define the first sound stage, and a fourth set of weights for applying to the component channel signals for each of the fixed speakers to define the second sound stage, with the audio system combining the third set of weights and the fourth set of weights to determine a second combined set of weights, the relative contribution of the third set of weights and the fourth set of weights in the second combined set of weights being determined by the variable user-input value, a mixed signal corresponding to a combination of the component channel signals according to the second combined set of weights for each of the fixed speakers, the mixed signals being output by the corresponding fixed speakers. The first and third sets of weights may cause a different set of the fixed speakers and near-field speakers to dominate spatial perception of the soundstage than the second and fourth sets, such that which set of speakers dominates spatial perception varies as the user-input value may be varied.

The near-field speakers may be located in a headrest of the automobile. The near-field speakers may be coupled to a body structure of the automobile. The relative contribution of the first set of weights and the second set of weights in the combined set of weights may vary according to a predetermined curve mapping the variable user-input value to the relative contribution. The predetermined curve may be not linear. The relative contribution of the first set of weights and the second set of weights in the combined set of weights may be determined automatically based on a characteristic of the input audio signal.

In general, in one aspect, adjusting signals in an automobile audio system having at least two near-field speakers located close to an intended position of a listener's head includes determining a first binaural filter that causes sound produced by each of the near-field speakers to have characteristics at the intended position of the listener's head of sound produced by a sound source located at a first designated position other than the actual locations of the near-field speakers, determining a second binaural filter that causes sound produced by each of the near-field speakers to have characteristics at the intended position of the listener's head of sound produced by a sound source located at a second designated position other than the actual locations of the near-field speakers and different from the first designated position, determining an up-mixing rule to generate at least three component channel signals from an input audio signal having at least two channels, mixing a set of the component channel signals to form a first mixed signal, filtering the mixed signal with a combination of the first binaural filter and the second binaural filter to generate a binaural output signal, and outputting the binaural output signal using the near-field speakers. The relative weight of the first binaural filter and the second binaural filter in the binaural output signal are determined by a variable user-input value.

Implementations may include one or more of the following, in any combination. The audio system may include at least a first fixed speaker positioned near a left corner of the vehicle's cabin forward of the intended position of the listener's head, and a second fixed speaker positioned near a right corner of the vehicle's cabin forward of the intended position of the listener's head, with a first set of weights for applying to the component channel signals for each of the fixed speakers defining the first sound stage, and a second set of weights for applying to the component channel signals for each of the fixed speakers defining the second sound stage. The audio system combines the first set of weights and the second set of weights to determine a combined set of weights, the relative contribution of the first set of weights and the second set of weights in the combined set of weights being determined by the variable user-input value. A mixed signal corresponding to a combination of the component channel signals according to the combined set of weights for each of the fixed speakers is output using the corresponding fixed speakers. The first binaural filter and first set of weights may cause a different set of the fixed speakers and near-field speakers to dominate spatial perception of the soundstage than the second binaural filter and second set of weights, such that which set of speakers dominates spatial perception varies as the user-input value is varied.

In general, in one aspect, signals in an automobile audio system having at least two near-field speakers located close to an intended position of a listener's head are adjusted such that in a first mode, audio signals are distributed to the near-field speakers according to a first filter that causes the listener to perceive a wide soundstage, and in a second mode, the audio signals are distributed to the near-field speakers according to a second filter that causes the listener to perceive a narrow soundstage. A user input of a variable value is received and, in response, distribution of the audio signals is transitioned from the first mode to the second mode, the extent of the transition being variable based on the value of the user input.

Implementations may include one or more of the following, in any combination. Transitioning the distribution of the audio signals may include applying both the first and second filters to the audio signals in a weighted sum, the relative weights of the first and second filters being based on the value of the user input.

In general, in one aspect, an automobile audio system includes at least two near-field speakers located close to an intended position of a listener's head, a user input generating a variable value, and an audio signal processor configured to, in a first mode, distribute audio signals to the near-field speakers according to a first filter that causes the listener to perceive a wide soundstage in a second mode, distribute the audio signals to the near-field speakers according to a second filter that causes the listener to perceive a narrow soundstage, and in response to a change in the value of the user input, transition distribution of the audio signals from the first mode to the second mode, the extent of the transition being variable based on the value of the user input.

Implementations may include one or more of the following, in any combination. The audio signal processor may include a memory storing a set of binaural filters that causes sound produced by each of the near-field speakers to have characteristics at the intended position of the listener's head of sound produced by a sound source located at each of a set of designated positions other than the actual locations of the near-field speakers, a first set of weights for applying to a set of component channel signals for each of the designated positions to define a first sound stage, and a second set of weights for applying to the set of component channel signals for each of the designated positions to define a second sound stage. The audio signal processor may transition distribution of the audio signals from the first mode to the second mode by applying an up-mixing rule to generate at least three component channel signals from an input audio signal having at least two channels, combining the first set of weights and the second set of weights to determine a combined set of weights, the relative contribution of the first set of weights and the second set of weights in the combined set of weights being determined by the value of the user input, determining a mixed signal corresponding to a combination of the component channel signals according to the combined set of weights for each of the designated positions, filtering each mixed signal using the corresponding binaural filter to generate a set of binaural output signals, summing the filtered binaural signals, and outputting the summed binaural signals to the near-field speakers. The audio signal processor may include a memory storing a first binaural filter that causes sound produced by each of the near-field speakers to have characteristics at the intended position of the listener's head of sound produced by a sound source located at a first designated position other than the actual locations of the near-field speakers and a second binaural filter that causes sound produced by each of the near-field speakers to have characteristics at the intended position of the listener's head of sound produced by a sound source located at a second designated position other than the actual locations of the near-field speakers and different from the first designated position. The audio signal processor may transition distribution of the audio signals from the first mode to the second mode by applying an up-mixing rule to generate at least three component channel signals from an input audio signal having at least two channels, mixing a set of the component channel signals to form a first mixed signal, filtering the mixed signal with a combination of the first binaural filter and the second binaural filter to generate a binaural output signal, and outputting the binaural output signal using the near-field speakers, the relative weight of the first binaural filter and the second binaural filter in the binaural output signal being determined by the value of the user input. Advantages include providing a user experience that responds to a variable sound stage control in a more immersive manner than a traditional fader control, and providing user control of sound stage spaciousness.

All examples and features mentioned above can be combined in any technically possible way. Other features and advantages will be apparent from the description and the claims.

DESCRIPTION

U.S. patent application Ser. No. 13/888927, incorporated here by reference, describes an audio system using near-field speakers located near the heads of the passengers, and a method of configuring that audio system to control the sound stage perceived by each passenger.

Figure 1:
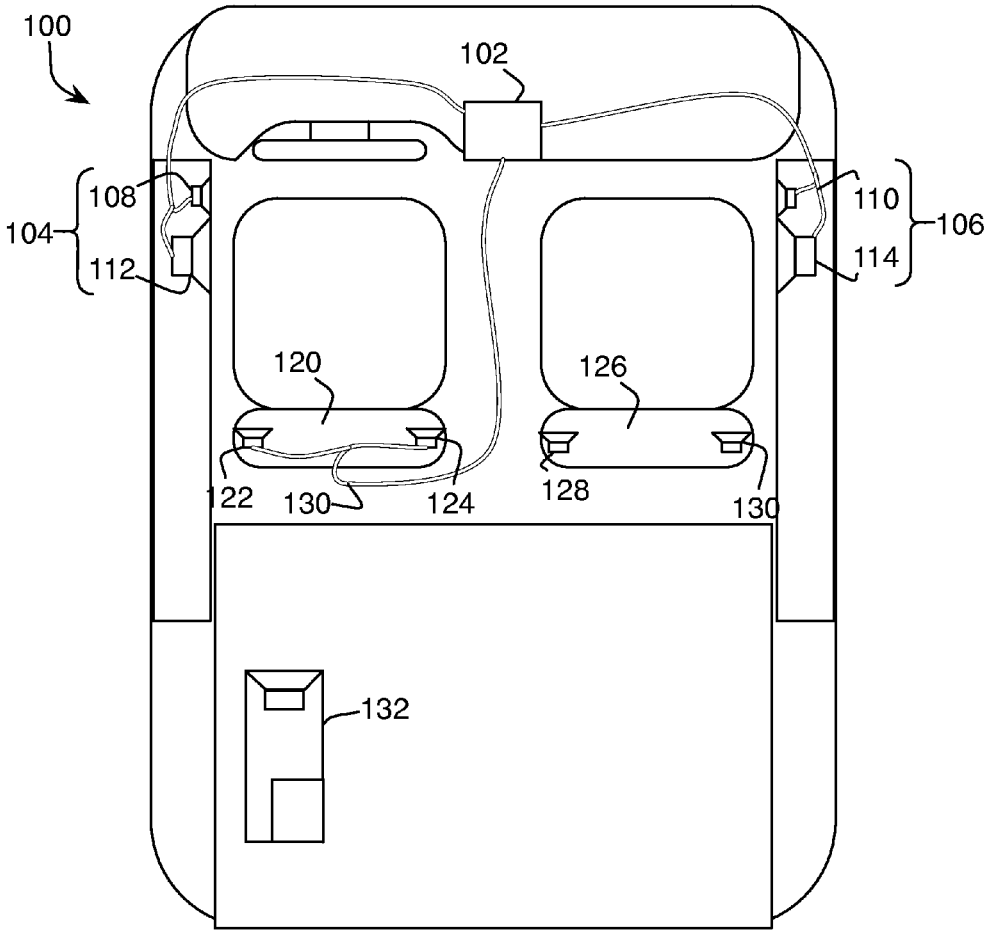
FIG. 1 shows a schematic diagram of a headrest-based audio system in an automobile.

Conventional car audio systems are based around a set of four or more speakers, two on the instrument panel or in the front doors and two generally located on the rear package shelf, in sedans and coupes, or in the rear doors or walls in wagons and hatchbacks. In some cars, however, as shown in FIG. 1, speakers may be provided in the headrest or other close location rather than in the traditional locations behind the driver. This saves space in the rear of the car, and doesn't waste energy providing sound to a back seat that, if even present, is unlikely to be used for passengers. The audio system 100 shown in FIG. 1 includes a combined source/processing/amplifying unit 102. In some examples, the different functions may be divided between multiple components. In particular, the source is often separated from the amplifier, and the processing provided by either the source or the amplifier, though the processing may also be provided by a separate component. The processing may also be provided by software loaded onto a general purpose computer providing functions of the source and/or the amplifier. We refer to signal processing and amplification provided by "the system" generally, without specifying any particular system architecture or technology.

The audio system shown in FIG. 1 has two sets of speakers 104, 106 permanently attached to the vehicle structure. We refer to these as "fixed" speakers. In the example of FIG. 1, each set of fixed speakers includes two speaker elements, commonly a tweeter 108, 110, and a low-to-mid range speaker element 112, 114. In another common arrangement, the smaller speaker is a mid-to-high frequency speaker element and the larger speaker is a woofer, or low-frequency speaker element. The two or more elements may be combined into a single enclosure or may be installed separately. The speaker elements in each set may be driven by a single amplified signal from the amplifier, with a passive crossover network (which may be embedded in one or both speakers) distributing signals in different frequency ranges to the appropriate speaker elements. Alternatively, the amplifier may provide a band-limited signal directly to each speaker element. In other examples, full range speakers are used, and in still other examples, more than two speakers are used per set. Each individual speaker shown may also be implemented as an array of speakers, which may allow more sophisticated shaping of the sound, or simply a more economical use of space and materials to deliver a given sound pressure level.

The driver's headrest 120 in FIG. 1 includes two speakers 122, 124, which again are shown abstractly and may in fact each be arrays of speaker elements. The two 122, 124 speakers (whether individual speakers or arrays) may be operated cooperatively as an array themselves to control the distribution of sound to the listener's ears. The speakers are located close to the listener's ears, and are referred to as near-field speakers. In some examples, they are located physically inside the headrest. The two speakers may be located at either end of the headrest, roughly corresponding to the expected separation of the driver's ears, leaving space in between for the cushion of the headrest, which is of course its primary function. In some examples, the speakers are located closer together at the rear of the headrest, with the sound delivered to the front of the headrest through an enclosure surrounding the cushion. The speakers may be oriented relative to each other and to the headrest components in a variety of ways, depending on the mechanical demands of the headrest and the acoustic goals of the system. Co-pending application Ser. No. 13/799,703, incorporated here by reference, describes several designs for packaging the speakers in the headrest without compromising the safety features of the headrest. The near-field speakers are shown in FIG. 1 as connected to the source 102 by cabling 130 going through the seat, though they may also communicate with the source 102 wirelessly, with the cabling providing only power. In another arrangement, a single pair of wires provides both digital data and power for an amplifier embedded in the seat or headrest.

Binaural Response and Correction

Figure 2:
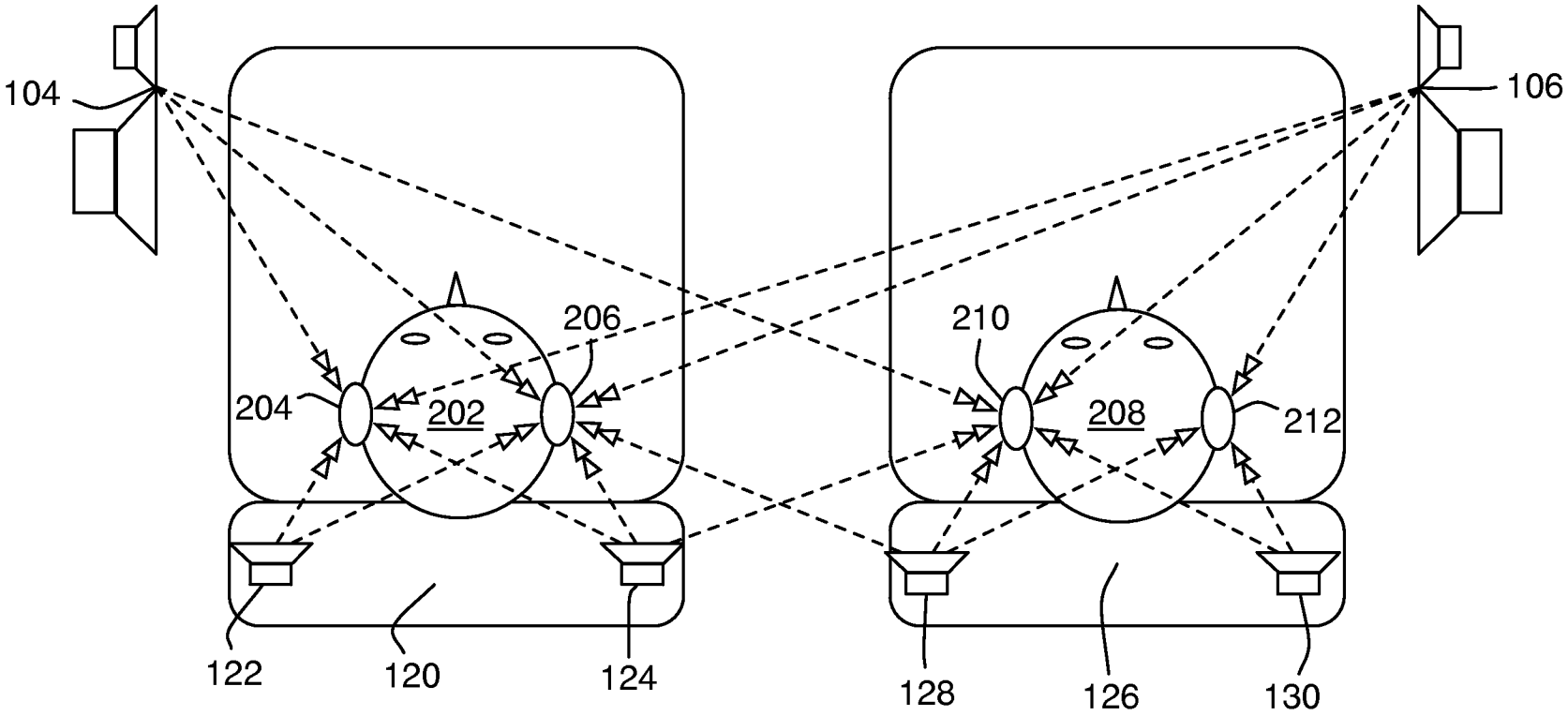
FIG. 2 shows paths by which sound from each of the speakers in the system of FIG. 1 reaches the ears of listeners.

FIG. 2 shows two listener's heads as they are expected to be located relative to the speakers from FIG. 1. Driver 202 has a left ear 204 and right ear 206, and passenger 208's ears are labeled 210 and 212. Dashed arrows show various paths sound takes from the speakers to the listeners' ears as described below. We refer to these arrows as "signals" or "paths," though in actual practice, we are not assuming that the speakers can control the direction of the sound they radiate, though that may be possible. Multiple signals assigned to each speaker are superimposed to create the ultimate output signal, and some of the energy from each speaker may travel omnidirectionally, depending on frequency and the speaker's acoustic design. The arrows merely show conceptually the different combinations of speaker and ear for easy reference. If arrays or other directional speaker technology is used, the signals may be provided to different combinations of speakers to provide some directional control. These arrays could be in the headrest as shown or in other locations relatively close to the listener including locations in front of the listener.

The near-field speakers can be used, with appropriate signal processing, to expand the spaciousness of the sound perceived by the listener, and more precisely control the frontal sound stage. Different effects may be desired for different components of the audio signals—center signals, for example, may be tightly focused, while surround signals may be intentionally diffuse. One way the spaciousness is controlled is by adjusting the signals sent to the near-field speakers to achieve a target binaural response at the listener's ears. As shown in FIG. 2 and more clearly in FIG. 3, each of the driver's ears 204, 206 hears sound generated by each local near-field speaker 122 and 124. The passenger similarly hears the speakers near the passenger's head. In addition to differences due to the distance between each speaker and each ear, what each ear hears from each speaker will vary due to the angle at which the signals arrive and the anatomy of the listener's outer ear structures (which may not be the same for their left and right ears).

Human perception of the direction and distance of sound sources is based on a combination of arrival time differences between the ears, signal level differences between the ears, and the particular effect that the listener's anatomy has on sound waves entering the ears from different directions, all of which is also frequency-dependent. We refer to the combination of these factors at both ears, for a source at a given location, as the binaural response for that location. Binaural signal filters are used to shape sound that will be reproduced at a speaker at one location to sound like it originated at another location.

Figure 3:
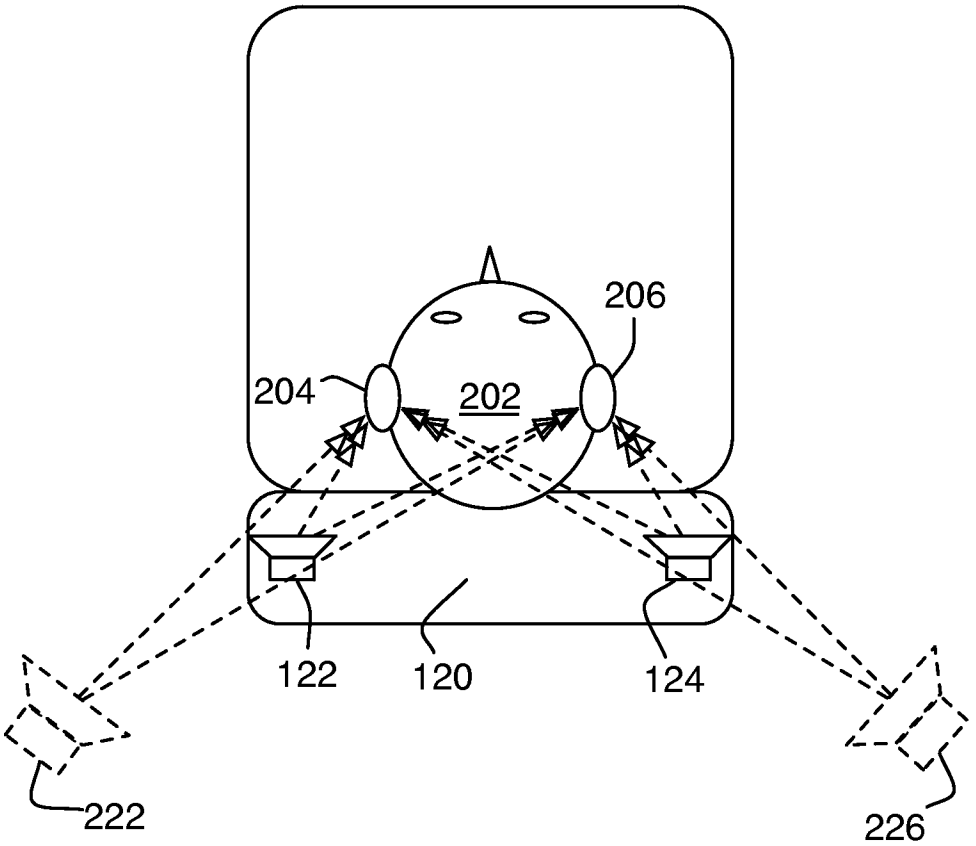
FIGS. 3 and 4 show the relationship between virtual speaker locations and real speaker locations.

Although a system cannot be designed a priori to account for the unique anatomy of an unknown future user, other aspects of binaural response can be measured and manipulated. FIG. 3 shows two "virtual" sound sources 222 and 226 corresponding to locations where surround speakers might ideally be located in a car that had them. In an actual car, however, such speakers would have to be located in the vehicle structure, which is unlikely to allow them to be in the location shown. Given these virtual sources' locations, the arrows showing sound paths from those speakers arrive at the user's ears at slightly different angles than the sound paths from the near-field speakers 122 and 124. Binaural signal filters modify the sound played back at the near-field speakers so that the listener perceives the filtered sound as if it is coming from the virtual sources, rather than from the actual near-field speakers. In some examples, it is desirable for the sound the driver perceives to seem as if it is coming from a diffuse region of space, rather than from a discrete virtual speaker location. Appropriate modifications to the binaural filters can provide this effect, as discussed below.

The signals intended to be localized from the virtual sources are modified to attain a close approximation to the target binaural response of the virtual source with the inclusion of the response from near-field speakers to ears. Mathematically, we can call the frequency-domain binaural response to the virtual sources V(s), and the response from the real speakers, directly to the listener's ears, R(s). If a sound S(s) were played at the location of the virtual sources, the user would hear S(s)×V(s). For same sound played at the near-field speakers, without correction, the user will hear S(s)×R(s). Ideally, by first filtering the signals with a filter having a transfer function equivalent to V(s)/R(s), the sound S(s)×V(s)/R(s) will be played back over the near-field speakers, and the user will hear S(s)×V(s)×R(s)/R(s)=S(s)×V(s). There are limits to how far this can be taken—if the virtual source locations are too far from the real near-field speaker locations, for example, it may be impossible to combine the responses in a way that produces a stable filter or it may be very susceptible to head movement. One limiting factor is the cross-talk cancellation filter, which prevents signals meant for one ear from reaching the other ear.

Component Signal Distribution

One aspect of the audio experience that is controlled by the tuning of the car is the sound stage. "Sound stage" refers to the listener's perception of where the sound is coming from. In particular, it is generally desired that a sound stage be wide (sound comes from both sides of the listener), deep (sound comes from both near and far), and precise (the listener can identify where a particular sound appears to be coming from). In an ideal system, someone listening to recorded music can close their eyes, imagine that they are at a live performance, and point out where each musician is located. A related concept is "envelopment," by which we refer to the perception that sound is coming from all directions, including from behind the listener, independently of whether the sound is precisely localizable. Perception of sound stage and envelopment (and sound location generally) is based on level and arrival-time (phase) differences between sounds arriving at both of a listener's ears, and sound stage can be controlled by manipulating the audio signals produced by the speakers to control these inter-aural level and time differences. As described in U.S. Pat. No. 8,325,936, incorporated here by reference, not only the near-field speakers but also the fixed speakers may be used cooperatively to control spatial perception.

If a near-field speaker-based system is used alone, the sound will be perceived as coming from behind the listener, since that is indeed where the speakers are. Binaural filtering can bring the sound somewhat forward, but it isn't sufficient to reproduce the binaural response of a sound truly coming from in front of the listener. However, when properly combined with speakers in front of the driver, such as in the traditional fixed locations on the instrument panel or in the doors, the near-field speakers can be used to improve the staging of the sound coming from the front speakers. That is, in addition to replacing the rear-seat speakers to provide "rear" sound, the near-field speaker are used to focus and control the listener's perception of the sound coming from the front of the car. This can provide a wider or deeper, and more controlled, sound stage than the front speakers alone could provide. The near-field speakers can also be used to provide different effects for different portions of the source audio. For example, the near-field speakers can be used to tighten the center image, providing a more precise center image than the fixed left and right speakers alone can provide, while at the same time providing more diffuse and enveloping surround signals than conventional rear speakers.

In some examples, the audio source provides only two channels, i.e., left and right stereo audio. Two other common options are four channels, i.e., left and right for both front and rear, and five channels for surround sound sources (usually with a sixth "point one" channel for low-frequency effects). Four channels are normally found when a standard automotive head unit is used, in which case the two front and two rear channels will usually have the same content, but may be at different levels due to "fader" settings in the head unit. To properly mix sounds for a system as described herein, the two or more channels of input audio are up-mixed into an intermediate number of components corresponding to different directions from which the sound may appear to come, and then re-mixed into output channels meant for each specific speaker in the system, as described with reference to FIGS. 4 and 5. One example of such up-mixing and re-mixing is described in U.S. Pat. No. 7,630,500, incorporated here by reference.

Figure 4:
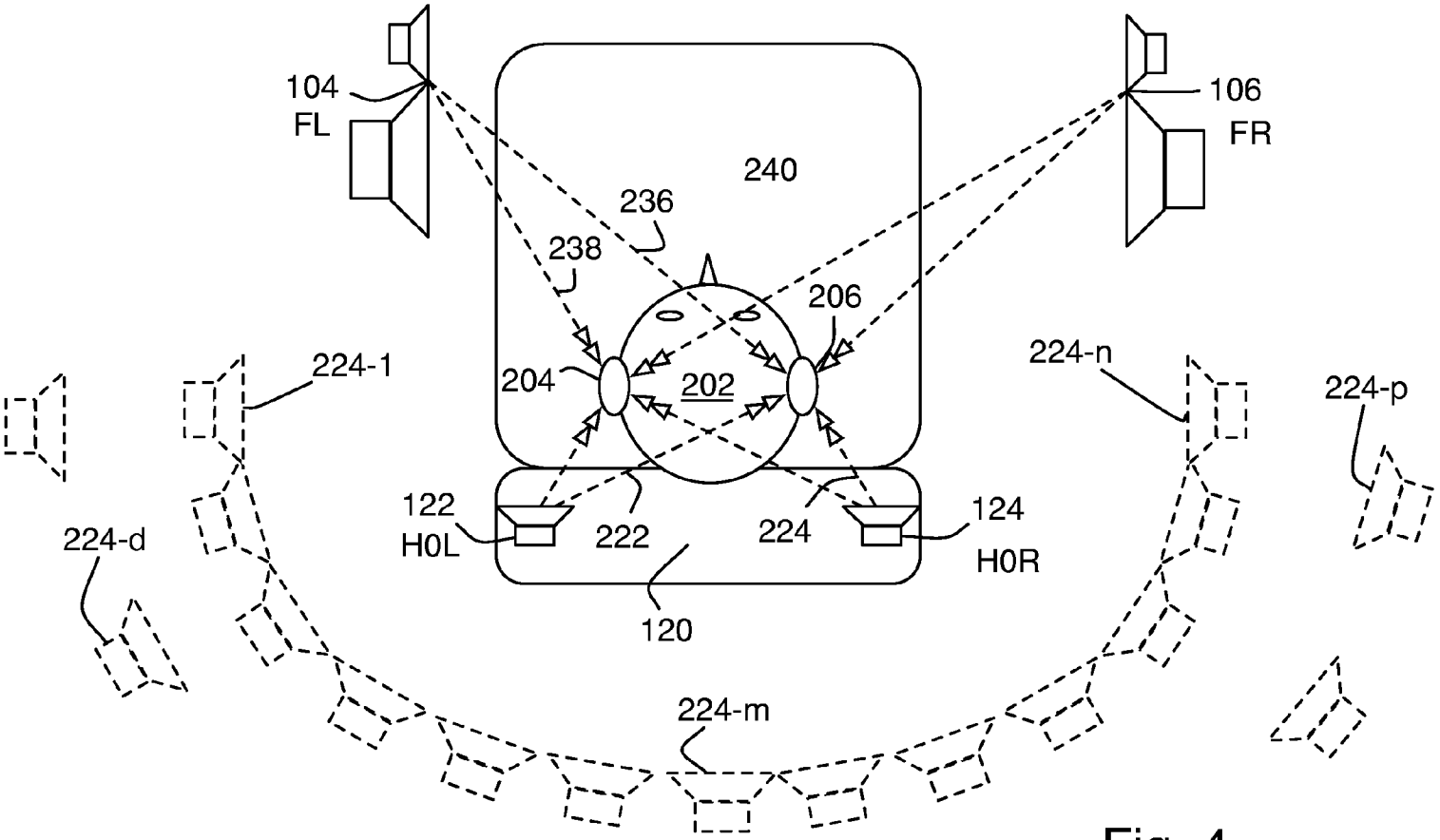

An advantage of the present system is that the component signals up-mixed from the source material can each be distributed to different virtual speakers for rendering by the audio system. As explained with regard to FIG. 3, the near-field speakers can be used to make sound seem to be coming from virtual speakers at different locations. As shown in FIG. 4, an array of virtual speakers 224*i* can be created surrounding the listener's rear hemisphere. Five speakers, 224-1, 224-*d*, 224-*m*, 224-*n*, and 224-*p* are labeled for convenience only. The actual number of virtual speakers may depend on the processing power of the system used to generate them, or the acoustic needs of the system. Although the virtual speakers are shown as a number of virtual speakers on the left (e.g., 224-1 and 224-*d*) and right (e.g., 224-*n* and 224-*p*) and one in the center (224-*m*), there may also be multiple virtual center speakers, and the virtual speakers may be distributed in height as well as left, right, front, and back.

A given up-mixed component signal may be distributed to any one or more of the virtual speakers, which not only allows repositioning of the component signal's perceived location, but also provides the ability to render a given component as either a tightly focused sound, from one of the virtual speakers, or as a diffuse sound, coming from several of the virtual speakers simultaneously. To achieve these effects, a portion of each component is mixed into each output channel (though that portion may be zero for some component-output channel combinations). For example, the audio signal for a right component will be mostly distributed to the right fixed speaker FR 106, but to position each virtual image 224-*i* on the right side of the headrest, such as 224-*n* and 224-*p*, portions of the right component signal are also distributed to the right near-field speaker and left near-field speaker, due to both the target binaural response of the virtual image and for cross-talk cancellation. The audio signal for the center component will be distributed to the corresponding right and left fixed speakers 104 and 106, with some portion also distributed to both the right and left near-field speakers 122 and 124, controlling the location, e.g., 224-*m*, from which the listener perceives the virtual center component to originate. Note that the listener won't actually perceive the center component as coming from behind if the system is tuned properly—the center component content coming from the front fixed speakers will pull the perceived location forward, the virtual center simply helps to control how tight or diffuse, and how far forward, the center component image is perceived. The particular distribution of component content to the output channels will vary based on how many and which near-field speakers are installed. Mixing the component signals for the near-field speakers includes altering the signals to account for the difference between the binaural response to the components, if they were coming from real speakers, and the binaural response of the near-field speakers, as described above with reference to FIG. 3.

FIG. 4 also shows the layout of the real speakers, from FIG. 1. The real speakers are labeled with notations for the signals they reproduce, i.e., left front (LF), right front (FR), left driver headrest (H0L), and right driver headrest (H0R). While the output signals FL and FR will ultimately be balanced for both the driver and passenger seats, the near-field speakers allow the driver and passenger to perceive the left and right peripheral components and the center component closer to the ideal locations . If the near-field speakers cannot on their own generate a forward-staged component, they can be used in combination with the front fixed speakers to move the left and right components outboard and to control where the user perceives the center components. An additional array of speakers close to but forward of the listener's head would allow the creation of a second hemisphere of virtual locations in front of the listener.

Figure 5:
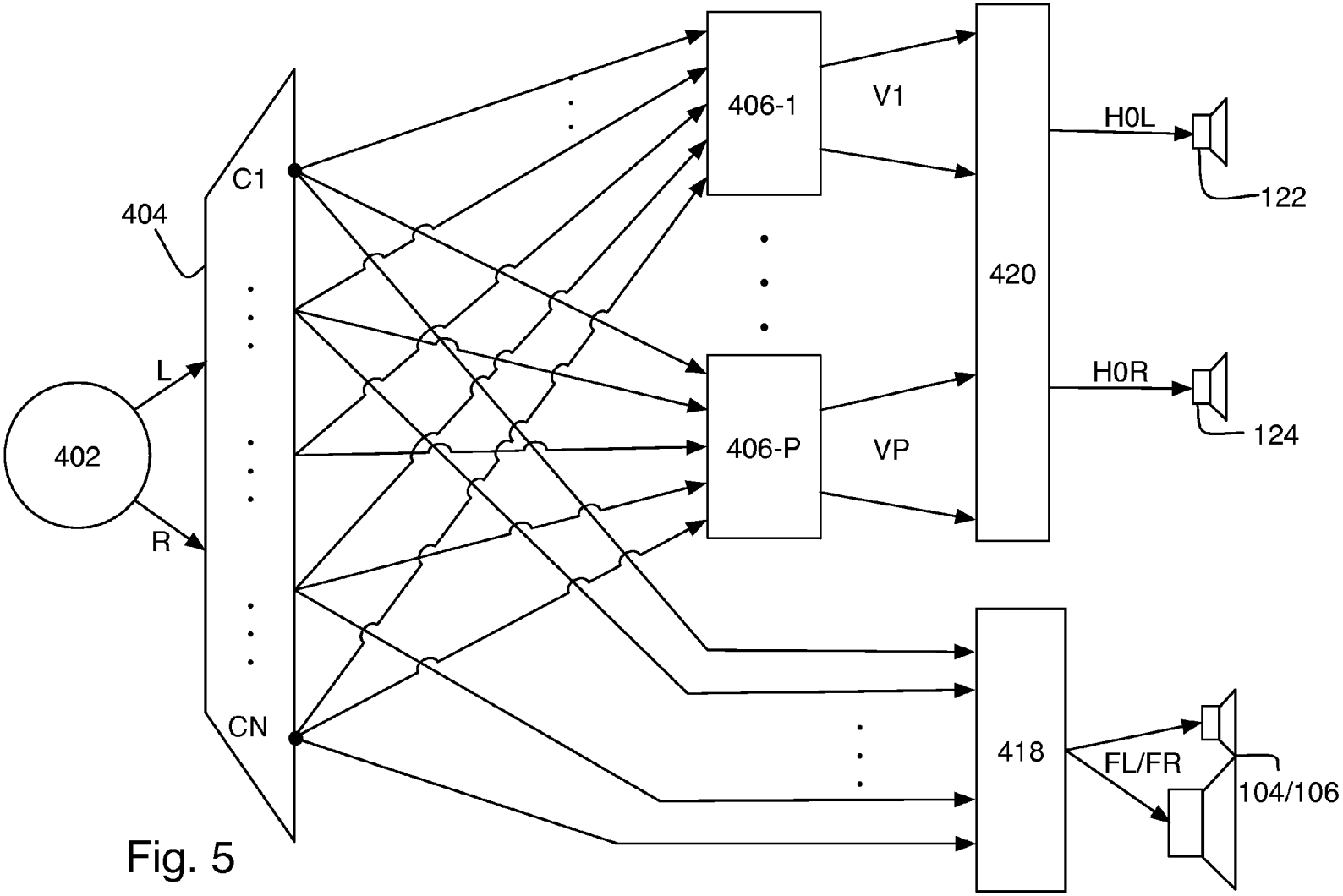
FIG. 5 schematically shows the process of up-mixing and re-mixing audio signals.

We use "component" to refer to each of the intermediate directional assignments to which the original source material is up-mixed. As shown in FIG. 5, a stereo signal is up-mixed into an arbitrary number N of component signals. For one example, there may be a total of five: front and surround for each of left and right, plus a center component. In such an example, the main left and right components may be derived from signals which are found only in the corresponding original left or right stereo signals. The center components may be made up of signals that are correlated in both the left and right stereo signals, and in-phase with each other. The surround components may be correlated but out of phase between the left and right stereo signals. Any number of up-mixed components may be possible, depending on the processing power used and the content of the source material. Various algorithms can be used to up-mix two or more signals into any number of component signals. One example of such up-mixing is described in U.S. Pat. No. 7,630,500, incorporated here by reference. Another example is the Pro Logic IIz algorithm, from Dolby®, which separates an input audio stream into as many as nine components, including height channels. In general, we treat components as being associated with left, right, or center. Left components are preferably associated with the left side of the vehicle, but may be located front, back, high, or low. Similarly right components are preferably associated with the right side of the vehicle, and may be located front, back, high, or low. Center components are preferably associated with the centerline of the vehicle, but may also be located front, back, high, or low. FIG. 5 shows an arbitrary number N of up-mixed components.

The relationship between component signals, generally C1 through CN, virtual image signals, V1 through VP, and output signals FL, FR, H0L, and H0R is shown in FIG. 5. A source 402 provides two or more original channels, shown as L and R. An up-mixing module 404 converts the input signals L and R into a number, N, of component signals C1 through CN. There may not be a discrete center component, but center may be provided a combination of one or more left and right components. Binaural filters 406-1 through 406-P then convert weighted sums of the up-mixed component signals into a binaural signal corresponding to sound coming from the virtual image locations V1 through VP, corresponding to the virtual speakers 224-*i* shown in FIG. 4. While FIG. 5 shows each of the binaural filters receiving all of the component signals, in practice, each virtual speaker location will likely reproduce sounds from only a subset of the component signals, such as those signals associated with the corresponding side of the vehicle. As with the component signals, a virtual center signal may actually be a combination of left and right virtual images. Re-mixing stages 418 (only one shown) recombine the up-mixed component signals to generate the FL and FR output signals for delivery to the front fixed speakers, and a binaural mixing stage 420 combines the binaural virtual image signals to generate the two headrest output channels H0L and H0R. The same process is used to generate output signals for the passenger headrest and any additional headrest or other near-field binaural speaker arrays, and additional re-mixing stages are used to generate output signals for any additional fixed speakers. Various topologies of when component signals are combined and when they are converted into binaural signals are possible, and may be selected based on the processing capabilities of the system used to implement the filters, or on the processes used to define the tuning of the vehicle, for example. The U.S. patent application Ser. No. 13/888,927 mentioned above describes the signal flows within the near-field mixing stage 420 and peripheral speaker re-mixing stage 418.

Fader and Sound Stage Controls

Another particular feature that can be provided with the system described above is a replacement for the traditional "fader" control. In typical car audio systems, with a set of stereo speakers in the front and another set of stereo speakers in the rear playing a scaled version of the same signal, a fader control adjusts the balance of sound energy between the front and rear speakers. For a full front setting, only the front speakers receive signal, and for a full rear setting, only the rear signals receive a signal. In the system described above, this would not be desirable, assuming the headrest speakers would be substituted for the rear speakers, as the signals going to the front and to the headrest speakers do not contain the same content, and don't play sound in the same bandwidths. Instead, a new interpretation of the fader is provided, which manipulates the mixing of component content into virtual image locations and fixed speaker signals. As discussed above, a binaural filter is designed that adjusts each virtual signal to account for the difference in binaural perception between signals coming from the virtual locations and the real speaker locations. Each virtual signal receives a mix of weighted component signals, which determines the location from which the listener perceives each component signal to originate. Rather than simply shifting sound energy between front and rear, this mixing can be varied for each virtual image location to change the precision and location of each component and the amount of envelopment provided by the virtual images.

Figure 6A:
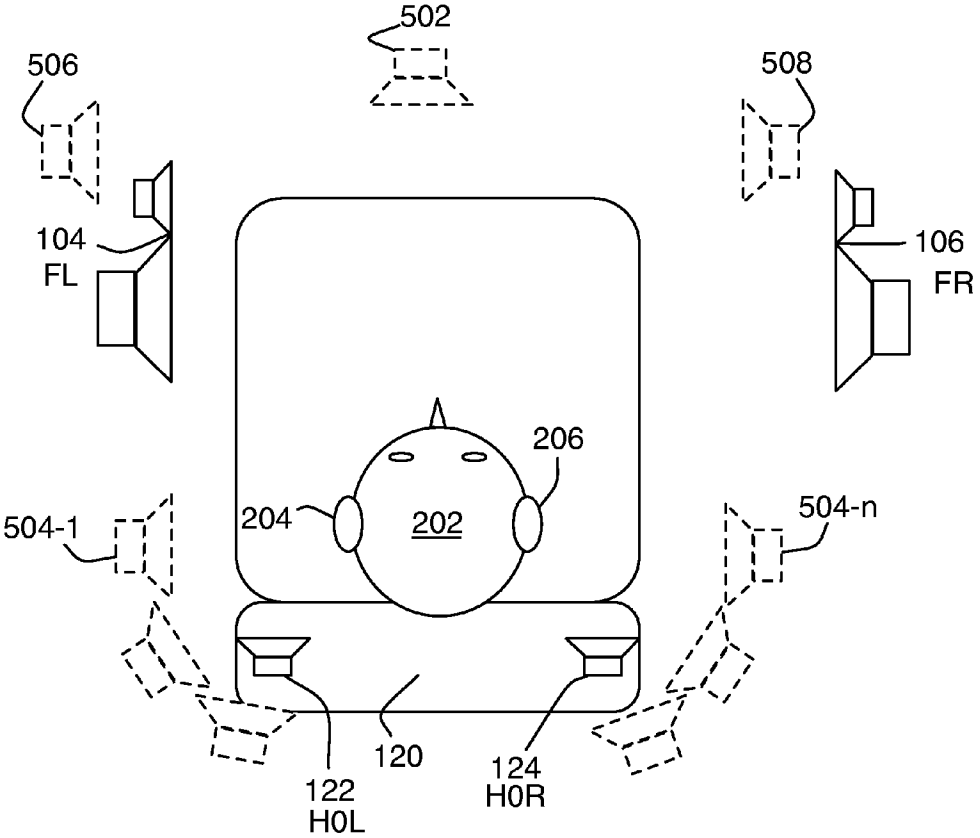
FIGS. 6A and 6B show two possible sound stage configurations.
Figure 6B:
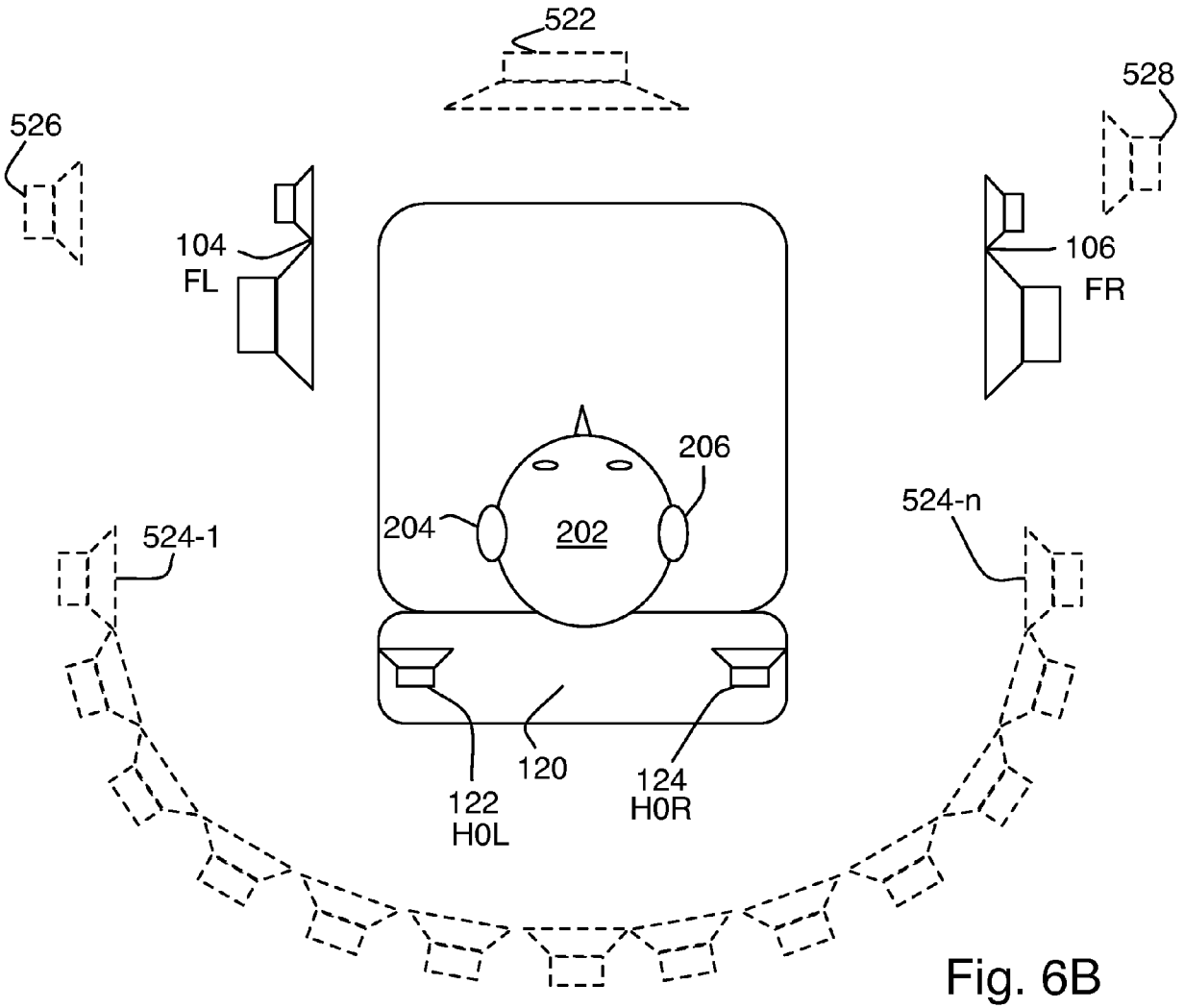

To provide a sound stage control instead of a traditional fader function, two different sets of component mixing weights are designed, based on two different sound stage presentations. In some examples, as shown in FIGS. 6A and 6B, different types of changes are made to different components. For the first set of mixing weights, associated with the sound stage control being at a first limit of its range and illustrated in FIG. 6A, the virtual center image is tightly focused at a point 502 in front of the driver, while virtual surround images 504-1 through 504-*n* are also tightly focused but are close to the driver, and left and right images 506 and 508 are close to the center, so the sound stage is narrow. Appropriate mixing weights are created for each set of virtual images. For the second set of mixing weights, associated with the sound stage control being at the other limit of its range, a center image 522 that is still centered, but is larger in width and possibly height or depth is combined with surround images 524-1 through 524-n that are more enveloping and farther away from the driver. The left and right images 526 and 528 are moved farther from center, and also rearward, due to the lack of actual width available in the car, to provide a wider sound stage. Other choices in mapping sound stage to control position are possible, depending on the desires of the system designer and the actual number of speakers used. In addition to the components input to the binaural filters that create the binaural virtual image signals, the weights of the components in the re-mixing stages 418 for the front fixed speakers are also modified, changing the mix of components into the front speakers.

Figure 7:
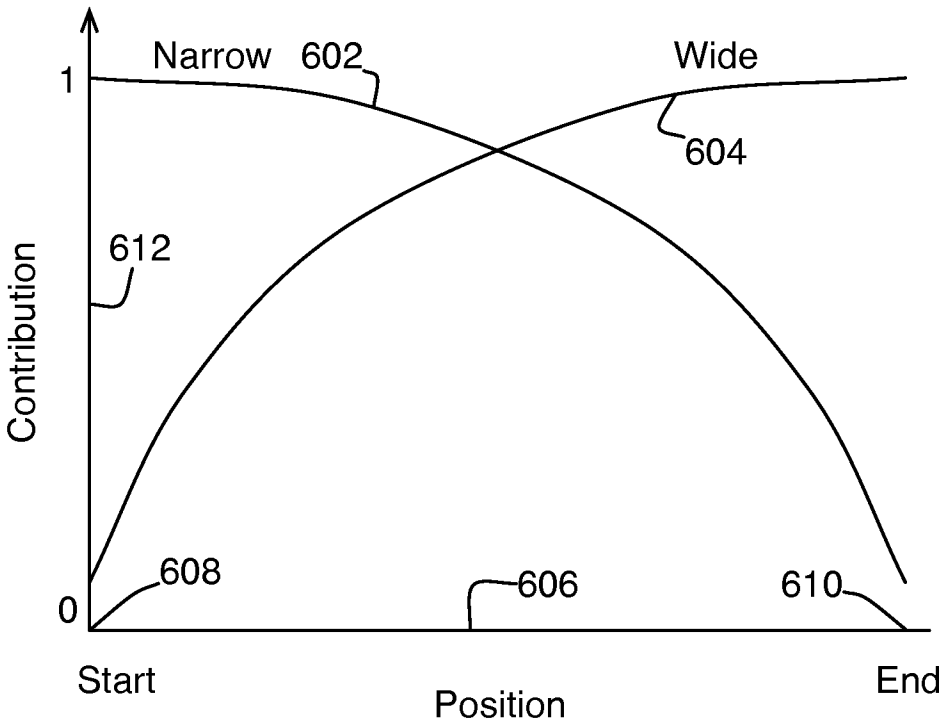
FIG. 7 shows a fader profile for transitioning between and mixing the sound stage configurations of FIGS. 6A and 6B.

To effect a transition between the two sound stage configurations as the user adjusts the control, both sets of weights are applied simultaneously, with the relative contribution of each set of weights set based on the position of the sound stage control, as shown in FIG. 7. FIG. 7 shows two curves 602 and 604 representing the contribution of the two sets of weights as functions of the sound stage control position. The horizontal axis 606 is the control position, ranging a start position 608 to an end position 610. The start and end positions of the control may be labeled various things in a given application, such as narrow to wide, front to rear (e.g., if a traditional "fader" control is repurposed), or solo to orchestra, to name a few examples. The vertical axis 612 is the contribution of each set of weights, ranging from zero to one. Note that this graph is entirely abstract—the actual values may be other than zero and one, depending, for example, on the types of filters used to actually implement this control scheme.

If the sound stage control is all the way at the start position 608, the contribution of the first set of weights (curve 602) is set to one and the contribution of the second set of weights (curve 604) is zero. As the fader is moved to the middle and then all the way to the ending position 610, the contribution of the first set is decreased and the contribution of the second set is increased until, at the full end position, the first set has a contribution of zero and the second set has a contribution of one. The curves are labeled as "narrow" and "wide", but this is just a notation for convenience, as the actual description of the effect of the weights will vary in a given application, much like the control position labels mentioned above. Thus, the user can adjust the size of the sound stage from narrow and forward to wide and enveloping, or between whatever alternative a given system offers. These settings may also be applied automatically based on the content of the source audio signal, for example, talk radio may be played using the first set of weights with a narrow, forward sound stage, while music may be played using the second set of weights with a wider, more enveloping overall sound stage. The shape of the curves shown is merely for illustration purposes—other curves, including straight lines, could be used, depending on the desires of the system designer and the capabilities of the audio system.

In another embodiment, rather than or in addition to changing the mixing weights of the component signals, the binaural filters can be changed to move the virtual image locations. Two sets of binaural filters can be combined, based on a weight derived from the fader input control, such that the fader control determines which binaural filters are dominant and therefore where the virtual images are positioned. The fixed speakers may still be varied by changing the weights of the component signals mixed to form the output signals.

Embodiments of the systems and methods described above may comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

A number of implementations have been described. Nevertheless, it will be understood that additional modifications may be made without departing from the scope of the inventive concepts described herein, and, accordingly, other embodiments are within the scope of the following claims.

What is claimed is:

1. A computer-implemented method of adjusting signals in an automobile audio system having at least two near-field speakers located close to an intended position of a listener's head in a vehicle cabin of an automobile and at least a first fixed speaker and a second fixed speaker positioned near a left corner and a right corner, respectively, of the vehicle cabin forward of the intended position of the listener's head, the computer-implemented method comprising:

processing a source audio signal having at least two channels, including:

identifying content of the source audio signal as being of a first type or a second type; and upmixing the source audio signal to generate at least three component channel signals;

if the content is identified as being of the first type, defining a first soundstage including applying a first set of weights to the component channel signals for each of a set of designated positions other than the actual locations of the speakers, otherwise, defining a second soundstage including applying a second set of weights to the component channel signals for each of the set of designated positions;

receiving user input to effect a transition to a user-desired soundstage between the first soundstage and the second soundstage;

combining the first set of weights and the second set of weights to generate a combined set of weights, the relative contribution of the first set of weights and the second set of weights in the combined set of weights being based on a value of the user input; and defining the user-desired soundstage including applying the combined set of weights to the component channel signals at each of the set of designated positions.

2. The method of claim 1, wherein the first soundstage is narrow and forward and the second soundstage is wide and enveloping.

3. The method of claim 1, wherein the set of designated positions includes a virtual center position, a virtual front left position, a virtual front right position, and plurality of virtual surround positions.

4. The method of claim 3, wherein:

applying the first set of weights results in the virtual surround positions being closer to the intended position of the listener's head than that resulting from applying the second set of weights.

5. The method of claim 3, wherein:

applying the first set of weights results in both the virtual front left position and the virtual front right position being closer to the virtual center position than that resulting from applying the second set of weights.

6. The method of claim 1, wherein the near-field speakers are located in a headrest of the automobile.

7. An audio system for an automobile, the system comprising:

at least two near-field speakers located close to an intended position of a listener's head in a vehicle cabin of the automobile;

at least a first fixed speaker and a second fixed speaker positioned near a left corner and a right corner, respectively, of the vehicle cabin forward of the intended position of the listener's head; and an audio signal processor configured to:

process a source audio signal having at least two channels, including:

identify content of the source audio signal as being of a first type or a second type; and upmix the source audio signal to generate at least three component channel signals;

if the content is identified as being of the first type, define a first soundstage including applying a first set of weights to the component channel signals for each of a set of designated positions other than the actual locations of the speakers, otherwise, define a second soundstage including applying a second set of weights to the component channel signals for each of the set of designated positions;

receive user input to effect a transition to a user-desired soundstage between the first soundstage and the second soundstage;

combine the first set of weights and the second set of weights to generate a combined set of weights, the relative contribution of the first set of weights and the second set of weights in the combined set of weights being based on a value of the user input; and define the user-desired soundstage including applying the combined set of weights to the component channel signals at each of the set of designated positions.

8. The system of claim 7, wherein the first soundstage is narrow and forward and the second soundstage is wide and enveloping.

9. The system of claim 7, wherein the set of designated positions includes a virtual center position, a virtual front left position, a virtual front right position, and plurality of virtual surround positions.

10. The system of claim 9, wherein:

application of the first set of weights results in the virtual surround positions being closer to the intended position of the listener's head than that resulting from application of the second set of weights.

11. The system of claim 9, wherein:

application of the first set of weights results in both the virtual front left position and the virtual front right position being closer to the virtual center position than that resulting from application of the second set of weights.

12. The system of claim 7, wherein the near-field speakers are located in a headrest of the automobile.

13. The system of claim 7, further comprising:

a soundstage control configured to be moved between a start position and an ending position, wherein:

at the start position, a contribution of the first set of weights to the combined set of weights is at its maximum and a contribution of the second set of weights to the combined set of weights is at its minimum; and at the ending position, a contribution of the first set of weights to the combined set of weights is at its minimum and a contribution of the second set of weights to the combined set of weights is at its maximum.

14. The system of claim 7, further comprising:

a memory associating the first set of weights with a narrow soundstage presentation and the second set of weights with a wide soundstage presentation.

* * * * *